US009047841B2

(12) United States Patent
Song et al.

(10) Patent No.: US 9,047,841 B2
(45) Date of Patent: Jun. 2, 2015

(54) DISPLAY APPARATUS AND METHOD OF DRIVING THE SAME

(75) Inventors: JunYong Song, Seongnam-si (KR); Jaehoon Lee, Seoul (KR); Yu-Han Bae, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 418 days.

(21) Appl. No.: 13/104,087

(22) Filed: May 10, 2011

(65) Prior Publication Data

US 2012/0038616 A1 Feb. 16, 2012

(30) Foreign Application Priority Data

Aug. 16, 2010 (KR) ..... 10-2010-0078941

(51) Int. Cl.
*G09G 5/00* (2006.01)
*G09G 3/36* (2006.01)
*G09G 3/00* (2006.01)

(52) U.S. Cl.
CPC ..... *G09G 3/3677* (2013.01); *G09G 3/003* (2013.01); *G09G 2310/08* (2013.01)

(58) Field of Classification Search
CPC .. G09G 2310/08; G09G 3/003; G09G 3/3677
USPC ..... 345/204, 87, 212
See application file for complete search history.

(56) References Cited

U.S. PATENT DOCUMENTS

| | | | | |
|---|---|---|---|---|
| 7,583,247 | B2 | 9/2009 | Park et al. | |
| 2002/0080107 | A1* | 6/2002 | Fujimoto et al. | 345/87 |
| 2008/0122774 | A1* | 5/2008 | Jo et al. | 345/94 |
| 2011/0069044 | A1* | 3/2011 | Lee et al. | 345/204 |
| 2011/0090319 | A1* | 4/2011 | Kim et al. | 348/51 |

FOREIGN PATENT DOCUMENTS

| | | |
|---|---|---|
| JP | 2009092982 | 4/2009 |
| KR | 1020060020324 | 3/2006 |
| KR | 1020060107636 | 10/2006 |
| KR | 1020070037793 | 4/2007 |

* cited by examiner

*Primary Examiner* — Quan-Zhen Wang
*Assistant Examiner* — Tony Davis
(74) *Attorney, Agent, or Firm* — Cantor Colburn LLP

(57) ABSTRACT

A display apparatus includes: a display panel which displays an image based on a display mode; a data driver which provides data signals to the display panel; a gate driver which starts an operation thereof in response to a start signal, and comprises stages and at least two dummy stages, where the stages sequentially provides gate signals to the display panel; and a timing controller which selects a signal from the start signal and a reset signal based on the display mode and outputs the selected signal selected to the at least two dummy stages, where each stage receives a clock signal, a previous carry signal from a previous stage, a first subsequent carry signal from a first subsequent stage and a second subsequent carry signal from a second subsequent stage, and outputs a corresponding gate signal of the gate signals and a carry signal.

18 Claims, 8 Drawing Sheets

DISPLAY APPARATUS AND METHOD OF DRIVING THE SAME

This application claims priority to Korean Patent Application No. 2010-78941, filed on Aug. 16, 2010, and all the benefits accruing therefrom under 35 U.S.C. §119, the content of which in its entirety is herein incorporated by reference.

BACKGROUND OF THE INVENTION (1) Field of the Invention

The general inventive concept relates to a display apparatus and a method of driving the same. More particularly, the general inventive concept relates to a display apparatus which displays a three-dimensional image with improved quality and a method of driving the same.

(2) Description of the Related Art

A three-dimensional ("3D") image display apparatus typically displays left and right eye images having the binocular disparity to be discretely presented to left and right eyes of a viewer, respectively. When the viewer views the left eye images with the left eye and the right eye images with the right eye, the brain of the viewer integrates the left and right eye images into a 3D image to recognize a 3D effect.

In general, the 3D image display apparatus alternately displays the left and right eye images on a display panel to implement the 3D image, and the viewer typically uses glasses synchronized with the 3D display apparatus to view the 3D image. In this case, the left eye image is recognized by the left eye and the right eye image is recognized by the right eye of the viewer.

The 3D image display apparatus employing the above scheme may require a longer blank duration per frame as compared to a two-dimensional ("2D") image display apparatus. When the blank duration is substantially lengthened, a substantial amount of noise may be generated in the 3D image display panel.

BRIEF SUMMARY OF THE INVENTION

Exemplary embodiments of the present invention provide a display apparatus which displays with improved 3D image quality.

Exemplary embodiments of the present invention also provide a method of driving the display apparatus.

In one exemplary embodiment, a display apparatus includes: a display panel which displays an image in response to a plurality of gate signals and a plurality of data signals based on a display mode; a data driver which provides the data signals to the display panel; a gate driver which starts an operation thereof in response to a start signal, and comprises a plurality of stages and at least two dummy stages, wherein the plurality of stages sequentially provides the gate signals to the display panel; and a timing controller which selects a signal from the start signal and a reset signal based on the display mode and outputs the signal selected from the start signal and the reset signal to the at least two dummy stages, where each of the plurality of stages receives a clock signal, a previous carry signal from a previous stage thereof, a first subsequent carry signal from a first subsequent stage thereof and a second subsequent carry signal from a second subsequent stage thereof, and outputs a corresponding gate signal of the gate signals and a carry signal, and where each of the at least two dummy stages receives the signal selected from the start signal and the reset signal as one of the first subsequent carry signal and the second subsequent carry signal.

In one exemplary embodiment, the timing controller may output the reset signal having a phase different from a phase of the start signal to the dummy stages when the display mode is a three-dimensional image mode, and output the start signal to the dummy stages when the display mode is a two-dimensional image mode.

In one exemplary embodiment, the at least two dummy stages of the gate driver may include: a first dummy stage which outputs a first dummy carry signal; and a second dummy stage which outputs a second dummy carry signal, where the first dummy stage receives the clock signal, a carry signal of a last stage of the plurality of stages, the signal selected from the start signal and the reset signal and the second dummy carry signal of the second dummy stage to output the first dummy carry signal, and where the second dummy stage receives the clock signal, the first dummy carry signal and the signal selected from the start signal and the reset signal to output the second dummy carry signal.

In one exemplary embodiment, the reset signal may include a first high duration in a blank duration, where the blank duration is defined as a time interval between a time point corresponding to a falling edge of a last gate signal of the gate signals and a time point corresponding to a rising edge of a subsequent high duration of the start signal.

In one exemplary embodiment, the reset signal may further include a second high duration synchronized with a high duration of the start signal.

In one exemplary embodiment, each of the plurality of stages may receive the previous carry signal from an adjacent previous stage thereof, and each of the plurality of stages may receive the first subsequent carry signal and the second subsequent carry signal from two subsequent stages disposed sequentially adjacent thereto.

In one exemplary embodiment, the gate driver may be directly formed on the display panel through a thin film process.

In one exemplary embodiment, each of the plurality of stages may include: a first output part which outputs a corresponding gate signal of the gate signals based on a potential of a first node; a second output part which outputs the carry signal based on a potential of the first node; a control part which increases the electrical potential of the first node in response to the previous carry signal, and decreases the corresponding gate signal to a first voltage in response to the first subsequent carry signal; and a holding part which receives the second subsequent carry signal, and supplies a second voltage lower than the first voltage to the first node.

In one exemplary embodiment, the controller may include: a buffer part which increases the electric potential of the first node in response to the previous carry signal; a first pull down part which decreases the corresponding gate signal to the first voltage in response to the first subsequent carry signal; a discharge part which decreases the electric potential of the first node to the second voltage in response to the first subsequent carry signal; and a second pull down part downing the carry signal to the second voltage in response to the first subsequent carry signal.

In one exemplary embodiment, each of the plurality of stages may further include: an inverter part which outputs the clock signal to a second node in response to the carry signal; and a second holding part which holds the gate signal and the carry signal with the first voltage according to potential of the second node.

In one exemplary embodiment, each of the plurality of stages may further include: a first stabilizing part which holds the potential of the first node with the second voltage according to the potential of the second node; and a second stabilizing part which holds the electric potential of the second node with the second voltage in response to the previous carry signal.

In an alternative exemplary embodiment, the display apparatus includes: a display panel which displays an image in response to gate signals and data signals; a data driver which provides the data signals to the display panel; a gate driver which starts an operation thereof in response to a start signal, and comprises a plurality of stages and at least two dummy stages, wherein the plurality of stages sequentially provides the gate signals to the display panel; and a timing controller which outputs a reset signal to the at least two dummy stages, wherein a phase of the reset signal is different from a phase of the start signal, where each of the plurality of stages receives a clock signal, a previous carry signal from a previous stage, a first subsequent carry signal from a first subsequent stage and a second subsequent carry signal from a second subsequent stage, and outputs a corresponding gate signal and a carry signal, and where each of the at least two dummy stages receives the reset signal as one of the first subsequent carry signal and the second subsequent carry signal.

In one exemplary embodiment, the at least two dummy stages of the gate driver may include: a first dummy stage which outputs a first dummy carry signal; and a second dummy stage which outputs a second dummy carry signal, where the first dummy stage receives the clock signal, a carry signal of a last stage of the plurality of stages, the reset signal and the second dummy carry signal of the second dummy stage to output the first dummy carry signal, and where the second dummy stage receives the clock signal, the first dummy carry signal, and the reset signal to output the second dummy carry signal.

In another exemplary embodiment, a method of driving the display apparatus including a gate driver which includes a plurality of stages and at least two dummy stages is provided. The method of driving the display apparatus includes: sequentially applying a plurality of gate signals to a display panel using a clock signal, a previous carry signal from a previous stage, a first carry signal from a first subsequent stage and a second carry signal from a second subsequent stage in response to a start signal; displaying an image to the display panel in response to the gate signals and a plurality of data signals based on a display mode; and selecting a signal from the start signal and a reset signal based on the display mode, and applying the signal selected from the start signal and the reset signal to each of the at least two dummy stages as the first carry signal and the second carry signal.

As described above, according to exemplary embodiments of the present invention, the timing controller applies the reset signal to the first and second dummy stages during the blank duration when the display mode is the three-dimensional mode, so that the transistor receiving the dummy carry signal of the last stage may be prevented from being degraded. Accordingly, the noise generated in the last gate line is effectively prevented, and the quality of the three-dimensional image of the display apparatus is substantially improved.

BRIEF DESCRIPTION OF THE DRAWINGS

The above and other aspects, advantages and features of the present invention will become more apparent by describing in further detail exemplary embodiments thereof with reference to the accompanying drawings, in which.

DETAILED DESCRIPTION OF THE INVENTION

Figure 1:
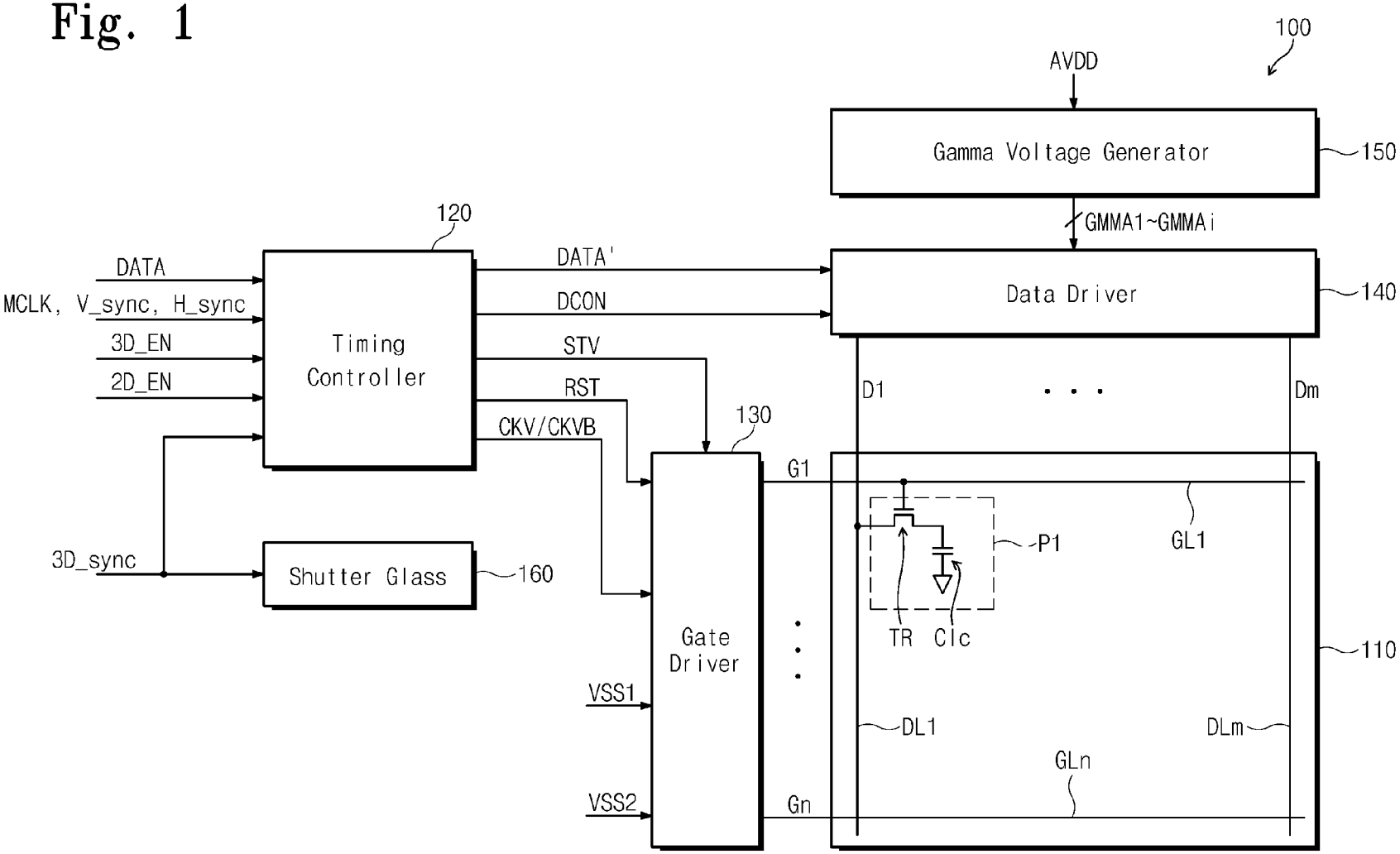
FIG. 1 is a block diagram showing an exemplary embodiment of a display apparatus according to the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the present invention will be described in detail with reference to accompanying drawings.

FIG. 1 is a block diagram showing an exemplary embodiment of a display apparatus 100 according to the present invention.

Referring to FIG. 1, the display apparatus 100 includes a display panel 110, a timing controller 120, a gate driver 130, a data driver 140, a gamma voltage generator 150 and shutter glasses 160.

The display panel 110 displays an image based on display modes, and the display panel 110 includes a plurality of pixels P1. The display panel 110 includes gate lines GL1 to GLn and data lines DL1 to DLm to provide signals to the pixels P1. Gate signals G1 to Gn are sequentially supplied to the gate lines GL1 to GLn, and data voltages D1 to Dm are applied to the data lines DL1 to DLm. Accordingly, if pixel rows are turned on in response to the gate signals G1 to Gn, the data voltages D1 to Dm are applied to the turned-on pixel rows, so that the pixels P1 in the pixel row may be scanned as a unit thereof. When all of the pixels P1 are scanned, one-frame image is displayed on the display panel 110. The display panel 110 may alternately display a left eye image and a right eye image in a three-dimensional ("3D") mode.

Each of the pixels P1 may include a thin film transistor TR connected to a corresponding gate line and a corresponding data line, a liquid crystal capacitor Clc connected to a drain electrode of the thin film transistor TR. However, the structure of the pixel P1 is not limited to the structure described above.

The timing controller 120 receives a plurality of image signals DATA from an outside of the display apparatus 100. The image signals DATA may be two-dimensional ("2D") image signals or 3D image signals. When the display apparatus 100 operates in the 3D mode, the timing controller 120 receives the image signals DATA corresponding to the 3D image. When the display apparatus 100 operates in a 2D mode, the timing controller 120 receives the image signals DATA corresponding to the 2D image.

The timing controller 120 receives a horizontal sync signal H_sync, a vertical sync signal V_sync, a main clock signal MCLK, a 3D sync signal 3D_Sync, a 3D enable signal 3D_EN, and a 2D enable signal 2D_EN. When the 2D enable signal 2D_EN is high, the display apparatus 100 operates in the 2D mode. When the 3D enable signal 3D_EN is high, the display apparatus 100 operates in the 3D mode.

The timing controller 120 converts the image signals DATA into a converted image signals DATA', such that the data format of the converted image signals DATA' correspond to the interface of the data driver 140, and provides the converted image signals DATA' to the data driver 140. In an exemplary embodiment, when the image signals DATA are 3D image signals, the timing controller 130 alternately transmits left eye image signals and right eye image signals to the data driver 140 in response to the 3D sync signal 3D_Sync. In an exemplary embodiment, the timing controller 120 provides data control signals DCON (e.g., an output start signal, a start signal, a clock signal and a polarity inverse signal) to the data driver 140, and provides a start signal STV, a clock signal CKV, a clock bar signal CKVB and a reset signal RST to the gate driver 130.

The gate driver 130 receives a first voltage VSS1 and a second voltage VSS2, and sequentially outputs the gate signals G1 to Gn in the response to the start signal STV, the clock signal CKV, the clock bar signal CKVB and the reset signal RST transmitted from the timing controller 120.

The data driver 140 selects voltages corresponding to the image signals DATA' from a plurality of gamma reference voltages GMMA1 to GMMAi in the response to the data control signal DCON transmitted from the timing controller 120, and outputs the voltages corresponding to the image signals DATA' as the data voltages D1 to Dm. The data voltages D1 to Dm are applied to the display panel 110.

The gamma voltage generator 150 receives an analog driving voltage AVDD to generate the gamma reference voltages GMMA1 to GMMAi, and supplies the gamma reference voltages GMMA1 to GMMAi to the data driver 140. The gamma voltage generator 150 may have a resistor string structure including a plurality of resistors (not shown) connected to each other in series between a terminal of the analog driving voltage AVDD and a ground terminal, and may output the electric potentials of connection nodes between two adjacent resistors as the gamma reference voltages GMMA1 to GMMAi.

In an exemplary embodiment, the shutter glasses 160 are used when the display apparatus 100 operates in the 3D mode. The shutter glasses 300 include a left eye shutter (not shown) and a right eye shutter (not shown). The shutter glasses 300 receive the 3D sync signal 3D_Sync, and alternately open and close the left eye shutter and the right eye shutter in response to the 3D sync signal 3D_Sync, that is, the left eye shutter is opened when the right eye shutter is closed, and the left eye shutter is closed when the right eye shutter is opened. When a user puts on the shutter glasses 300, the user may view an image displayed on the display panel 100 as a 3D image through the left eye shutter and the right eye shutter that are alternately opened and closed.

Hereinafter, the structure and operation of an exemplary embodiment of the gate driver 130 will be described in detail.

Figure 2A:
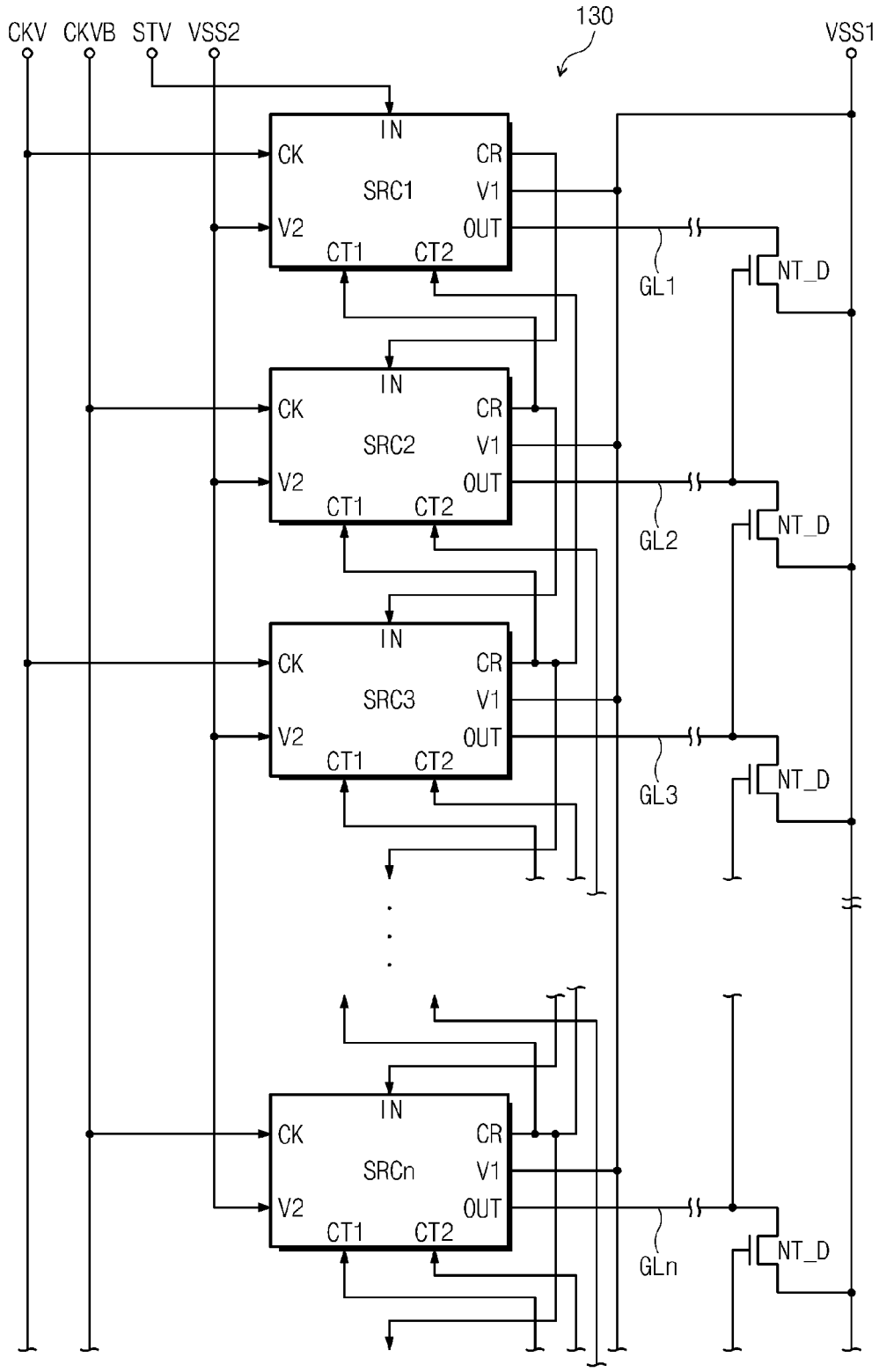
FIGS. 2A and 2B are block diagrams showing an exemplary embodiment of a gate driver according to the present invention.
Figure 2B:
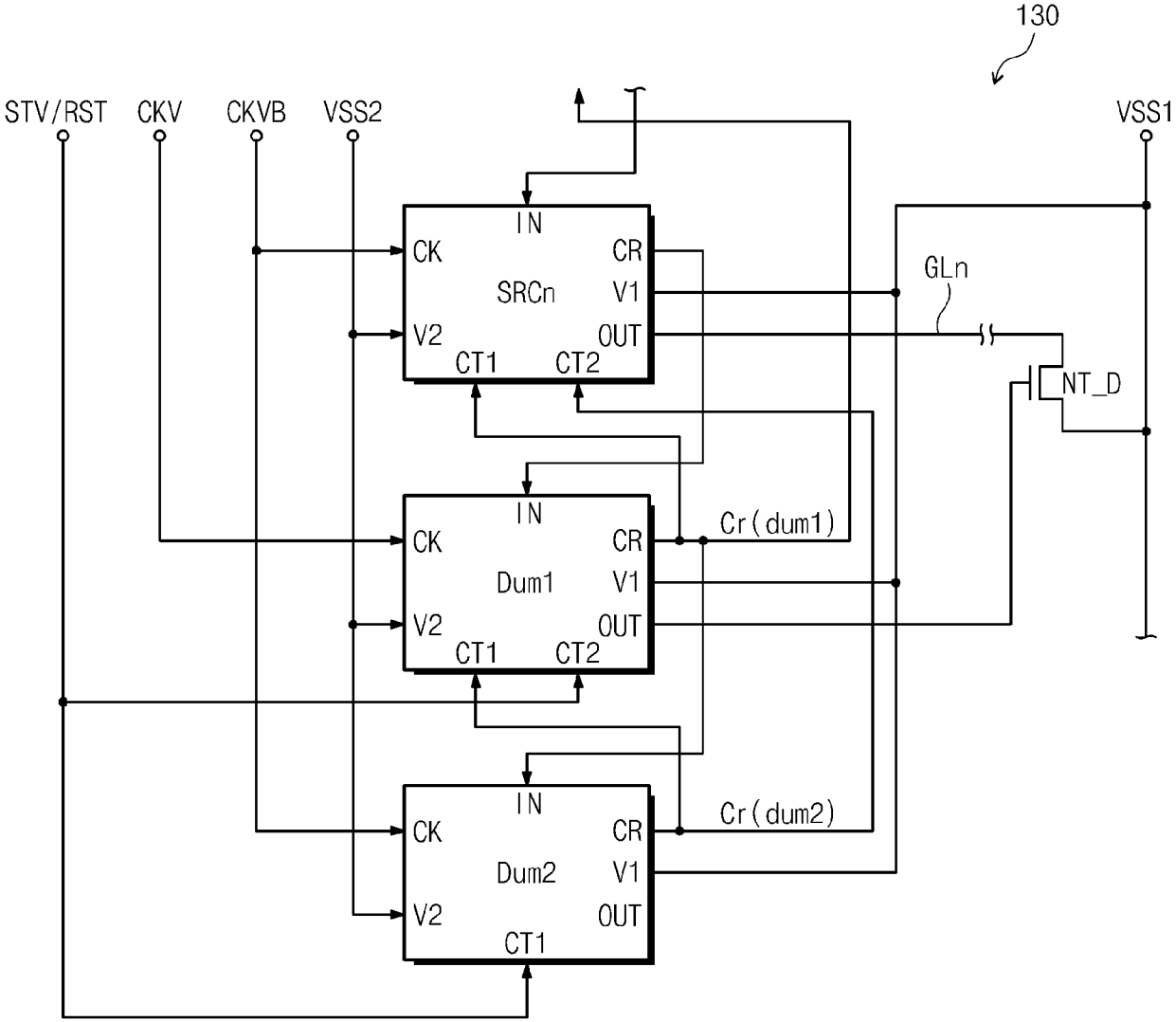

FIGS. 2A and 2B are block diagrams showing an exemplary embodiment of the gate driver 130 according to the present invention.

Referring to FIG. 2A, the gate driver 130 comprises a single shift register including a plurality of stages SRC1 to SRCn dependently connected to each other, where n is an integer greater than or equal to 1. Each of the stages SRC1 to SRCn is connected to a first terminal of a corresponding gate line of the gate lines GL1 to GLn, and the stages SRC1 to SRCn sequentially output gate signals to supply the gate signals to the gate lines corresponding thereto.

Each of the stages SRC1 to SRCn comprises an input terminal IN, a clock terminal CK, a first voltage terminal V1, a second voltage terminal V2, a first control terminal CT1, a second control terminal CT2, an output terminal OUT and a carry terminal CR.

The input terminal IN of each of the stages SRC1 to SRCn is electrically connected to the carry terminal CR of a first previous stage and receives a previous carry signal output from the first previous stage. In an exemplary embodiment, since the first stage SRC1 of the stages SRC1 to SRCn has no previous stage, the input terminal IN of the first stage SRC1 receives the start signal STV, which start the driving of the gate driver 130 and is transmitted from the timing controller 120, instead.

The first control terminal CT1 of each of the stages SRC1 to SRCn is electrically connected to the carry terminal CR of a first subsequent stage of subsequent stages thereof, and receives a first subsequent carry signal. The second control terminal CT2 of the stages SRC1 to SRCn is electrically connected to the carrier terminal CR of a second subsequent stage of the subsequent stages, which is disposed subsequent, e.g., next, to the first subsequent stage, and receives a second subsequent carry signal. Signals input to the first and second control terminals CT1 and CT2 of an N-th stage SRCn of the stages SRC1 to SRCn will be described later in detail with reference to FIG. 3.

In an exemplary embodiment, the clock terminals CK of odd-numbered stages, e.g., the first to (N−1)-th stages SRC1 to SRCn−1 of the stages SRC1 to SRCn, receive the clock signal CKV, and the clock terminals CK of even-numbered stages, e.g., the second to N-th stages SRC2 to SRCn of the stages SRC1 to SRCn, receive the clock bar signal CKVB. The clock signal CKV and the clock bar signal CKVB have different phases. In an exemplary embodiment, a phase of the clock signal CKV is inverted from a phase of the clock bar signal CKVB. In an alternative exemplary embodiment, where 'n' is an odd number, the (N−1)-th stage SRCn−1 may receive the clock bar signal CKVB, and the N-th stage SRCn may receive the clock signal CKV.

The first voltage VSS1 is applied to the first voltage terminal V1 of each of the stages SRC1 to SRCn, and the second voltage VSS2, which has a level less than a level of the first voltage VSS1, is applied to the second voltage terminal V2 of each of the stages SRC1 to SRCn. The first voltage VSS1 may be a ground voltage or a negative voltage. In an exemplary embodiment, the first voltage VSS1 may be about −6 volt (V), and the second voltage VSS2 may be about −12 volt (V).

The output terminal OUT of each of the stages SRC1 to SRCn is connected to the corresponding gate line. Accordingly, a gate signal output through the output terminal OUT is applied to the corresponding gate line.

The carry terminal CR of each of the stages SRC1 to SRCn is electrically connected to the input terminal IN of the first subsequent stage, the first control terminal CT1 of the first previous stage, and the second control terminal CT2 of a second previous stage, which is one of previous stages of the first previous stage, to provide a carry signal to the first control terminal CT1 of the first previous stage and the second control terminal CT2 of the second previous stage.

A discharge transistor NT_D is connected to a second terminal of each of the gate lines GL1 to GLn. The discharge transistor NT_D comprises a control electrode connected to a gate line subsequent to a corresponding gate line of the discharge transistor NT_D, an input electrode that receives the first voltage VSS1, and an output electrode connected to the corresponding gate line of the discharge transistor NT_D. Therefore, the discharge transistor NT_D discharges a gate signal of the corresponding gate line of the discharge transistor NT_D to the first voltage VSS1 in response to a subsequent gate signal applied to the subsequent gate line subsequent to the corresponding gate line of the discharge transistor NT_D.

Referring to FIG. 2B, the gate driver 130 further comprises at least two dummy stages, e.g., a first dummy stage Dum1 and a second dummy stage Dum2, in addition to the stages SRC1 to SRCn.

The first dummy stage Dum1 comprises the input terminal IN, the clock terminal CK, the first and second voltage terminals V1 and V2, the first and second control terminals CT1 and CT2, the output terminal OUT, and the carry terminal CR.

The first dummy stage Dum1 receives the carry signal of the N-th stage SRCn through the input terminal IN, and outputs a first dummy carry signal Cr(dum1) through the carry terminal CR and the output terminal OUT in response to the carry signal of the N-th stage SRCn.

In an exemplary embodiment, the carry terminal CR of the first dummy stage Dum1 is connected to the first control terminal CT1 of the N-th stage SRCn and the input terminal IN of the second dummy stage Dum2 to provide a first dummy carry signal Cr(dum1). Although not shown, the carry terminal CR of the first dummy stage Dum1 is connected to the second control terminal CT2 of an (N−1)-th stage SRCn−1 of the stages SRC1 to SRCn to supply the first dummy carry signal Cr(dum1) to the second terminal CT2 of the (N−1)-th stage SRCn−1.

The output terminal OUT of the first dummy stage Dum1 is connected to the control electrode of the discharge transistor NT_D connected to the N-th gate line GLn of the gate lines GL1 to GLn. Therefore, the discharge transistor NT_D connected to the Nth gate line GLn is turned on in response to the first dummy carry signal Cr(dum1) output through the output terminal OUT of the first dummy stage Dum1, and the discharge transistor NT_D, which is turned on, decreases the electric potential of the N-th gate line GLn to the first voltage VSS1.

The second dummy stage Dum2 comprises the input terminal IN, the clock terminal CK, the first and second voltage terminals V1 and V2, the first control terminal CT1, the output terminal OUT and the carry terminal CR.

The second dummy stage Dum2 receives the first dummy carry signal Cr(dum1) from the first dummy stage Dum1 through the input terminal IN, and outputs a second dummy carry signal Cr(dum2) through the carry terminal CR and the output terminal OUT in response to the first dummy carry signal Cr(dum1).

The carry terminal CR of the second dummy stage Dum2 is connected to the second control terminal CT2 of the N-th stage SRCn and the first control terminal CT1 of the first dummy stage Dum1, and supplies the second dummy carry signal Cr(dum2) to the second control terminal CT2 of the N-th stage SRCn and the first control terminal CT1 of the first dummy stage Dum1.

Therefore, the first and second control terminals CT1 and CT2 of the N-th stage SRCn may receive the first and second dummy carry signals Cr(dum1) and Cr(dum2) from the first and second dummy stages Dum1 and Dum2, respectively, and the N-th stage SRCn thereby operates similarly to the other stages, e.g., the first to (N−1)-th stages SRC1 to SRCn−1, through the first and second dummy stages Dum1 and Dum2.

As shown in FIG. 2B, the start signal STV or the reset signal RST is supplied to the second control terminal CT2 of the first dummy stage Dum1 based on the display modes according to an image to be displayed. In an exemplary embodiment, when the image mode is the 3D mode, the reset signal RST is supplied to the second control terminal CT2 of the first dummy stage Dum1, and when the image mode is the 2D mode, the start signal STV may be supplied to the second control terminal CT2 of the first dummy stage Dum1. The reset signal RST may have a phase different from the phase of the start signal STV.

Similarly to the first dummy stage Dum1, the start signal STV or the reset signal RST may be supplied to the first control terminal CT1 of the second dummy stage Dum2 based on the display modes. In an exemplary embodiment, the second control terminal CT2 may be omitted from the second dummy stage Dum2.

The signals supplied to the second control terminal CT2 of the first dummy stage Dum1 and the first control terminal CT1 of the second dummy stage Dum2 will be described later in detail with reference to FIGS. 4 to 6.

Figure 3:
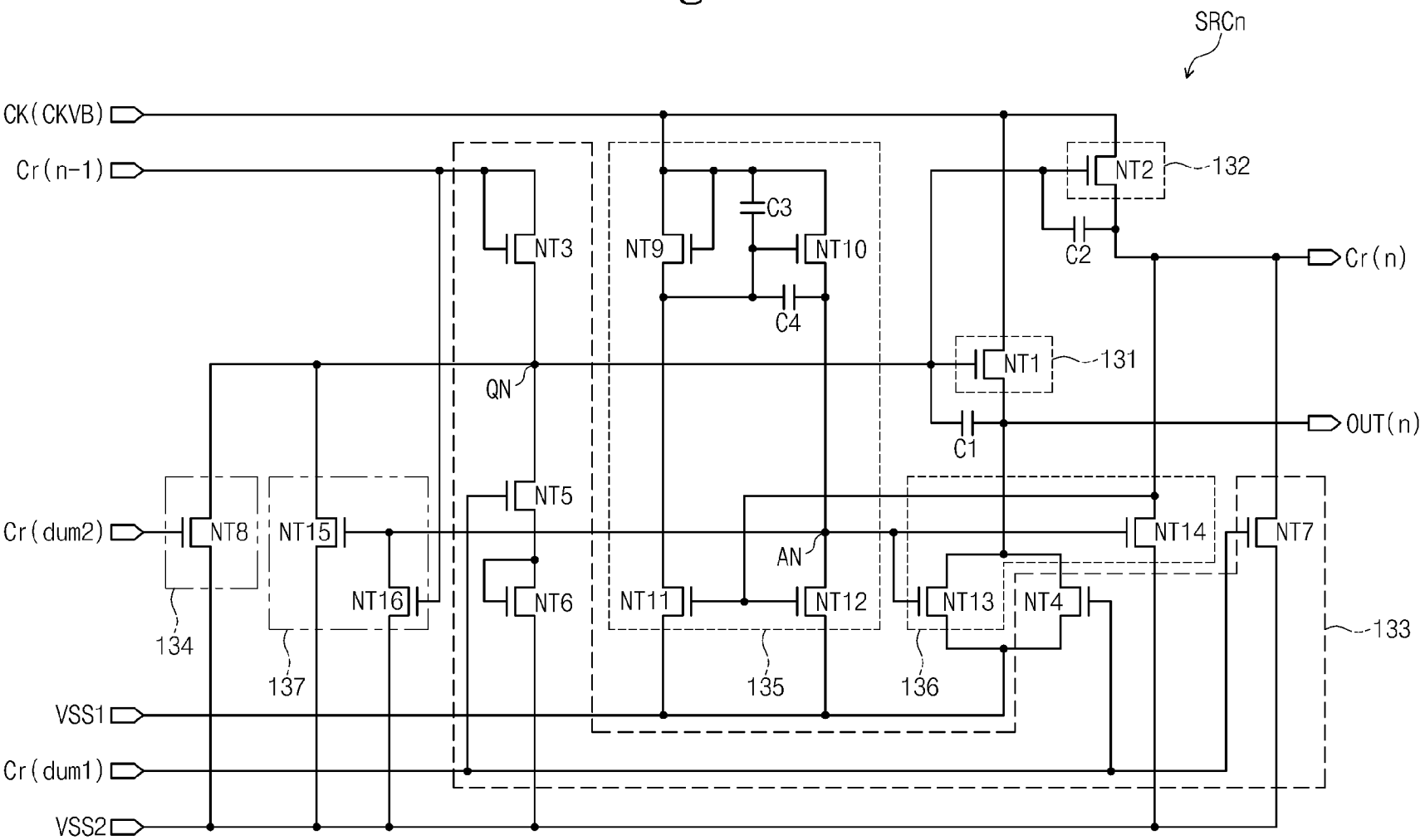
FIG. 3 is a schematic circuit diagram showing an N-th stage of a plurality of stages of FIG. 2A.

FIG. 3 is a schematic circuit diagram showing an exemplary embodiment of the N-th stage SRCn of the stages SRC1 to SRCn in FIGS. 2A and 2B. Although FIG. 3 illustrates only an exemplary embodiment of the N-th stage SRCn, of the stages SRC1 to SRCn, the other n−1 stages, e.g., the first to (N-1)-th stages SRC1 to SRCn−1, of the stages SRC1 to SRCn may have a structure similar to the structure of the N-th stage SRCn shown in FIG. 3 except for the signals input thereto, as shown in FIG. 2A.

Referring to FIG. 3, the N-th stage SRCn includes a first output part 131, a second output part 132, a controller 133, a first holding part 134, an inverter part 135, a second holding part 136, and a stabilizing part 137.

The first output part 131 outputs a gate signal OUT(n) corresponding to the electric potential of a first node, e.g., a Q-node QN, and the second output part 132 outputs a carry signal Cr(n) corresponding to the electric potential of the Q-node QN. The gate signal OUT(n) and the carry signal Cr(n) may be substantially similar to each other. In an exemplary embodiment, the gate signal OUT(n) and the carry signal Cr(n) have the same phase and the same size.

The first output part 131 comprises a first output transistor NT1, and the second output part 132 comprises a second output transistor NT2. The first output transistor NT1 includes an input electrode that receives the clock bar signal CKVB, a control electrode connected to the Q-node QN, and an output electrode connected to the output terminal OUT. The second output transistor NT2 includes an input electrode that receives the clock bar signal CKVB, a control electrode connected to the Q-node QN, and an output electrode connected to the carry terminal CR.

When the electric potential of the Q-node QN increases, the first and second output transistors NT1 and NT2 are turned on to output the clock bar signal CKVB as the gate signal OUT(n) and the carry signal Cr(n).

The controller 133 increases the electric potential of the Q-node QN in response to a previous carry signal Cr(n−1), and decreases the gate signal OUT(n) to the first voltage VSS1 in response to the first subsequent carry signal of the first subsequent stage, e.g., the first dummy carry signal Cr(dum1).

The controller 133 includes a buffer transistor NT3, first and second pull down transistors NT4 and NT7, and first and second discharge transistors NT5 and NT6.

The buffer transistor NT3 includes input and control electrodes commonly connected to the input terminal IN that receives the (N−1)-th carry signal Cr(n−1), and an output electrode connected to the Q-node QN. Accordingly, the buffer transistor NT3 may raise the electric potential of the Q-node QN in response to the (N−1)-th carry signal Cr(n−1).

The pull down transistor NT4 includes an input electrode connected to the output terminal OUT that receives the gate signal OUT(n), a control electrode connected to the first control terminal CT1 that receives the first dummy carry signal Cr(dum1), and an output electrode connected to the first voltage terminal V1. Accordingly, the first pull down transistor NT4 may decrease the gate signal OUT(n) to the first voltage VSS1 in response to the first dummy carry signal Cr(dum1).

The first discharge transistor NT5 includes an input electrode connected to the Q-node QN, a control electrode connected to the first control terminal CT1 that receives the first dummy carry signal Cr(dum1), and an output electrode connected to the second discharge transistor NT6. The second discharge transistor NT6 includes input and control electrodes commonly connected to the output electrode of the first discharge transistor NT5 and an output electrode connected to the second voltage terminal V2 that receives the second voltage VSS2. Accordingly, the first and second discharge transistors NT5 and NT6 may decrease the electric potential of the Q-node QN to the second voltage VSS2 in response to the first dummy carry signal Cr(dum1).

The second pull down transistor NT7 includes an input electrode connected to the carry terminal Cr to receive a carry signal Cr(n), a control electrode connected to the first control terminal CT1 to receive the first dummy carry signal Cr(dum1), and an output electrode connected to the second voltage terminal V2 to receive the second voltage VSS2. Accordingly, the second pull down transistor NT7 may decrease the carry signal Cr(n) to the second voltage VSS2 in response to the first dummy carry signal Cr(dum1).

The controller 133 further includes a first capacitor C1 and a second capacitor C2. The first capacitor C1 connected to the control and output electrodes of the first output transistor NT1, and the second capacitor C2 is connected to the control and output electrodes of the second output transistor NT2.

When the buffer transistor NT3 is turned on in response to the previous carry signal Cr(n−1), the electric potential of the Q-node QN increases, and the first and second output transistors NT1 and NT2 are thereby turned on. When the electric potentials of the output terminal OUT and the carry terminal CR are raised by the turned-on first and second output transistors NT1 and NT2, the electric potential of the Q-node QN is raised by the first and second capacitors C1 and C2. Therefore, the first and second output transistors NT1 and NT2 may be maintained in turn-on state by a bootstrapping operation using the first and second capacitors C1 and C2, and the gate signal OUT(n) and the carry signal Cr(n) may be generated to be in a high level for a high duration of the clock bar signal CKVB.

The first holding part 134 receives the second dummy carry signal Cr(dum2) and supplies the second voltage VSS2 lower than the first voltage VSS1 to the Q-node QN. The first holding part 134 includes a first holding transistor NT8 including an input electrode connected to the Q-node QN, a control electrode connected to the second control terminal CT2 to receive the second dummy carry signal Cr(dum2), and an output electrode connected to the second voltage terminal V2 to receive the second voltage VSS2.

The inverter part 135 outputs the clock bar signal CKVB to a second node, e.g., an A-node AN, in response to the carry signal Cr(n), and the second holding part 136 maintains the gate signal OUT(n) and the carry signal Cr(n) at the first voltage VSS1 in response to the clock bar signal CKVB received through the A-node AN.

The inverter part 135 includes first to fourth transistors NT9, NT10, NT11 and NT12, and third and fourth capacitors C3 and C4.

The first transistor NT9 includes input and control electrodes to receive the clock bar signal CKVB, and an output electrode connected to the third transistor NT11. The second transistor NT10 includes an input electrode to receive the clock bar signal CKVB, a control electrode connected to the output electrode of the first transistor NT9, and an output electrode connected to the A-node AN. The third capacitor C3 is connected to the input and control electrodes of the second transistor NT10, and the fourth capacitor C4 is connected to the control electrode and the output electrode of the second transistor NT10.

The third transistor NT11 includes an input electrode connected to the output electrode of the first transistor NT9, a control electrode connected to the carry terminal CR that receives the carry signal CR(n), and an output electrode connected to the first voltage terminal V1 that receives the first voltage VSS1. The fourth transistor NT12 includes an input electrode connected to the A-node AN, a control electrode connected to the carry terminal CR to receive the carry signal Cr(n), and an output electrode connected to the first voltage terminal V1 to receive the first voltage VSS1.

The second holding part 136 comprises second and third holding transistors NT13 and NT14. The second holding transistor NT13 includes an input electrode connected to the output terminal OUT to receive the gate signal OUT(n), a control electrode receiving the clock bar signal CKVB through the A-node AN, and an output electrode connected to the first voltage terminal V1. The third holding transistor NT14 includes an input electrode connected to the carry terminal CR that outputs the carry signal CR(n), a control electrode that receives the clock bar signal CKVB through the A-node AN, and an output electrode connected to the second voltage terminal V2.

The third and fourth capacitors C3 and C4 are slowly charged with a voltage by the clock bar signal CKVB. When the third and fourth capacitors C3 and C4 being charged, the second transistor NT10 is turned on by the charged voltage, and the electric potential of the A-node AN is raised when the third and fourth transistors NT11 and NT12 are turned off.

When the electric potential of the A-node AN increases, the second and third holding transistors NT13 and NT14 are turned on, and the gate signal OUT(n) and the carry signal Cr(n) may be held at the first and second voltages VSS1 and VSS2, respectively, by the turned-on second and third holding transistors NT13 and NT14.

Accordingly, the second holding part 136 may hold the gate signal OUT(n) at the first voltage VSS1 and hold the carry signal CR(n) at the second voltage VSS2 for the turn-off duration of the first output part 131.

As described above, the inverter part 135 of each stage holds the electric potential of the A-node AN at the first voltage VSS1 in response to the carry signal Cr(n) output from the stage of the inverter 135, and the electric potential of the A-node AN is thereby stabilized. Accordingly, the bootstrapping operation may be normally performed, and abnormal operation of the first and second output transistors NT1 and NT2 at a high temperature is thereby effectively prevented.

In an exemplary embodiment, the stabilizing part 137 includes a first stabilizing transistor NT15 that stabilizes the electric potential of the Q-node QN and a second stabilizing transistor NT16 that stabilizes the electric potential of the A-node AN.

The first stabilizing transistor NT15 includes an input electrode connected to the Q-node QN, a control electrode connected to the A-node AN, and an output electrode connected to the second voltage terminal V2. Accordingly, when the electric potential of the A-node AN increases, the first stabilizing transistor NT15 is turned on by the raised electric potential of the A-node AN, so that the electric potential of the Q-node QN may be held at the second voltage VSS2. The first stabilizing transistor NT15 may reduce the leakage current of the first output transistor NT1, and thereby prevents abnormal turn-on of the first output transistor NT1 at a high temperature.

The second stabilizing transistor NT16 includes an input electrode connected to the A-node AN, a control electrode connected to the input terminal IN that receives the previous carry signal Cr(n−1), and an output electrode connected to the second voltage terminal V2. The second stabilizing transistor NT16 lowers the electric potential of the A-node AN to the second voltage VSS2 in response to the previous carry signal Cr(n−1). In an exemplary embodiment, when the previous carry signal Cr(n−1) is shifted to a high level, the electric potential of the A-node AN is lowered to the second voltage VSS2, so that the second and third holding transistors NT13 and NT14 are shifted from a turn-on state to a turn-off state.

Figure 4:
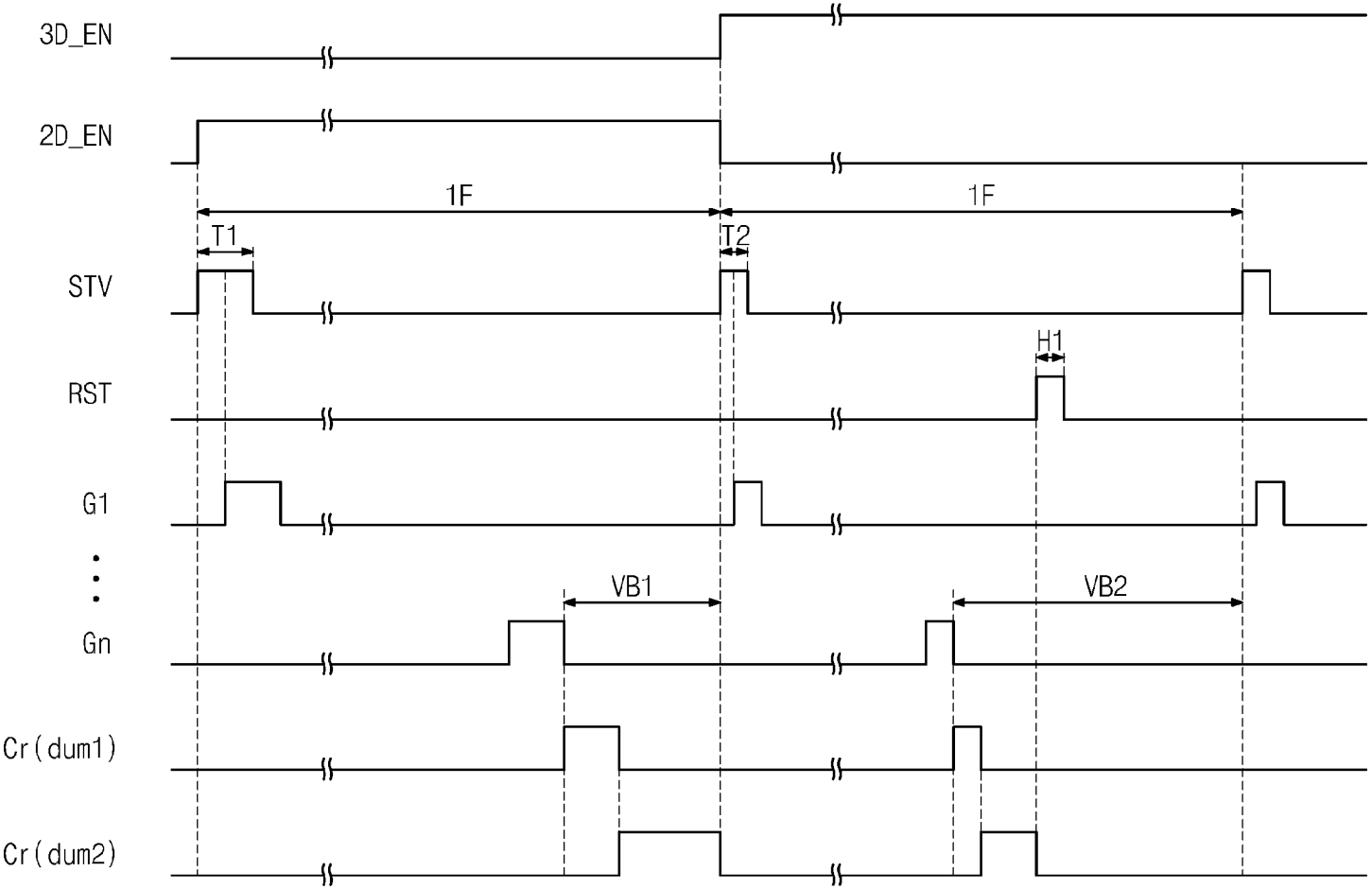
FIG. 4 is a signal timing diagram showing waveforms of a start signal, a reset signal, a gate signal, and first and second dummy carry signals of an exemplary embodiment of the display apparatus.

FIG. 4 is a signal timing diagram showing waveforms of the start signal STV, the reset signal RST, the gate signals G1 to Gn, and first and second dummy carry signals Cr(dum1) and Cr(dum2) of an exemplary embodiment of the display apparatus. For the purpose of explanation, FIG. 4 illustrates the 2D mode and the 3D mode.

Referring to FIG. 4, the start signal STV is generated at a high level during a unit time slot of one frame duration 1F. In an exemplary embodiment, the start signal STV is maintained at a high level during a first time slot T1 in the case of the 2D mode, and maintained at a high level during a second time slot T2 in the case of 3D mode.

Each frame duration 1F includes blank durations VB1 and VB2 defined as a range between the time point corresponding to a falling edge of the last gate signal Gn and the time point corresponding to the rising edge of a subsequent high duration of the start signal STV. Hereinafter, the blank duration of the 2D mode is called a first blank duration VB1 and the blank duration of the 3D mode is called a second blank duration VB2.

In an exemplary embodiment, the second blank duration VB2 is longer than the first blank duration VB1. Since the second blank duration VB2 is lengthened within one frame duration, an active duration (from the time point corresponding to a rising edge of the first gate signal G1 to the time point corresponding to the falling edge of the last gate signal Gn) of the 3D mode is shorter than an active duration of the 2D mode. The start signal STV is generated at a high level during the second time slot T2 shorter than the first time slot T1 in the 3D. When the start signal STV is generated at the high level, the operation of the first stage SRC1 of the plurality of stages starts SRC1 to SRCn. Accordingly, the gate signals G1 to Gn are sequentially output from the plurality of stages SRC1 to SRCn. After the N-th gate signal Gn has been output, the first and second dummy signals Cr(dum1) and Cr(dum2) are sequentially output.

The first dummy stage Dum1 receives the carry signal of the N-th stage, and output the first dummy carry signal Cr(dum1) having a high level through the carry terminal and the output terminal in response to the carry signal of the N-th stage. Thereafter, the first dummy stage Dum1 decreases the first dummy carry signal Cr(dum1) to a low level in response to the second dummy carry signal Cr(dum2).

In an exemplary embodiment, the second dummy stage Dum2 receives the first dummy carry signal Cr(dum1) from the first dummy stage Dum1, and outputs the second dummy carry signal Cr(dum2) having a high stage through the carry terminal CR and the output terminal OUT in response to the first dummy carry signal Cr(dum1). Thereafter, the second dummy stage Dum2 decreases the second dummy carry signal Cr(dum2) to a low level in response to the start signal STV.

When the 2D enable signal 2D_EN has a high level and the 3D enable signal 3D_EN has a low level, the display apparatus 100 operates in the 2D mode.

In the case of the 2D mode, the start signal STV is supplied to the second control terminal CT2 of the first dummy stage Dum1 and the first control terminal CT1 of the second dummy stage Dum2.

When the start signal STV is shifted to the high level, the second dummy stage Dum2 shifts the state of the second dummy carry signal Cr(dum2) to a low level. When the start signal STV is shifted to the high level, the first dummy stage Dum1 holds the first dummy carry signal Cr(dum1) at the low level.

When the 3D enable signal 3D_EN has a high level and the 2D enable signal 2D_EN has a low level, the display apparatus 100 operates in the 3D mode.

In the case of the 3D mode, the reset signal RST is supplied to the second control terminal CT2 of the first dummy stage Dum1 and the first control terminal CT1 of the second dummy stage Dum2.

The reset signal RST includes a first high duration H1 having a high level within the second blank duration VB2. In an exemplary embodiment, the reset signal RST having a high level is applied to the second control terminal CT2 of the first dummy stage Dum1 and the first control terminal CT1 of the second dummy stage Dum2 during the second blank duration VB2. In this case, the reset signal RST may be shifted to a high level after a predetermined clock elapses from the application of the clock signal CKV to the N-th stage.

When the reset signal RST is shifted to the high level, the second dummy stage Dum2 shifts the second dummy carry signal Cr(dum2) to the low level. When the reset signal RST is shifted to the high level, the first dummy stage Dum1 holds the first dummy carry signal Cr(dum1) at the low level.

As described above, in an exemplary embodiment, when the reset signal RST is applied to the first and second dummy stages Dum1 and Dum2 in the 3D mode, the second dummy carry signal Cr(dum2) is shifted to the low level more rapidly as compared to a case where the start signal STV is applied. Accordingly, since time when the first holding transistor N8 receiving the second dummy carry signal Cr(dum2) is turned on for an exemplary embodiment is shorter than that of conventional display apparatus, the first holding transistor NT8 is effectively prevented from being degraded, so that noise of the N-th gate signal G(n) is effective prevented.

Figure 5:
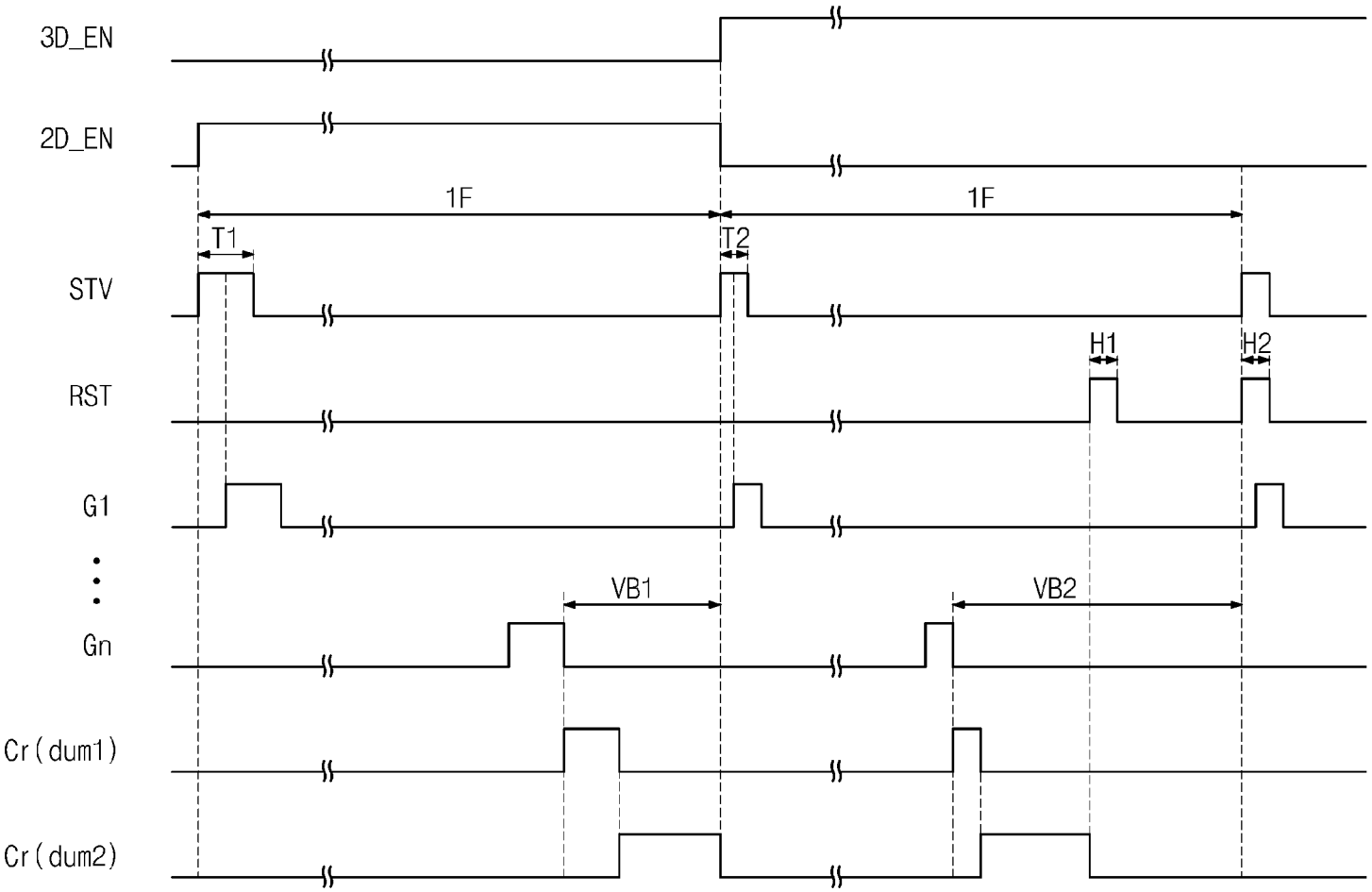
FIG. 5 is a signal timing diagram showing waveforms of a start signal, a reset signal, a gate signal, and first and second dummy carry signals of an alternative exemplary embodiment of the display apparatus.

FIG. 5 is a signal timing diagram showing waveforms of the start signal STV, the reset signal RST, the gate signals G1 to Gn, and first and second dummy carry signals Cr(dum1) and Cr(dum2) for an alternative exemplary embodiment.

Referring to FIG. 5, in the case of the 2D mode, the start signal STV is supplied to the second control terminal CT2 of the first dummy stage Dum1 and the first control terminal CT1 of the second dummy stage Dum2. The waveforms of the signals in 2D mode shown in FIG. 5 are substantially the same as the waveforms of the signals in 2D mode shown in FIG. 4 except for the reset signal RST. The same or like elements shown in FIG. 5 have been labeled with the same reference characters as used above to describe the exemplary embodiments of the waveforms shown in FIG. 4, and any repetitive detailed description thereof will hereinafter be omitted or simplified.

In the case of 3D mode, the reset signal RST is supplied to the second control terminal CT2 of the first dummy stage Dum1 and the first control terminal CT1 of the second dummy stage Dum2.

The reset signal RST includes the first high duration H1 having a high level within the second blank duration VB2. In an exemplary embodiment, the reset signal RST having a high level is applied to the second control terminal CT2 of the first dummy stage Dum1 and the first control terminal CT1 of the second dummy stage Dum2 for the second blank duration VB2. The reset signal RST includes the second high duration H2 synchronized with the start signal STV.

When the reset signal RST is shifted to the high level, the second dummy stage Dum2 shifts the second dummy carry signal Cr(dum2) to the low level. When the reset signal RST is shifted to the high level, the first dummy stage Dum 1 holds the first dummy carry signal Cr(dum1) at the low level.

In an exemplary embodiment, since a duration at which the start signal STV synchronized with the reset signal RST exists, timing at which the reset signal RST is applied may be efficiently controlled as compared to that of conventional display apparatus. In other words, if the second high duration H2 synchronizes with the start signal STV, the start time point of the first high duration H1 can be easily changed.

Figure 6:
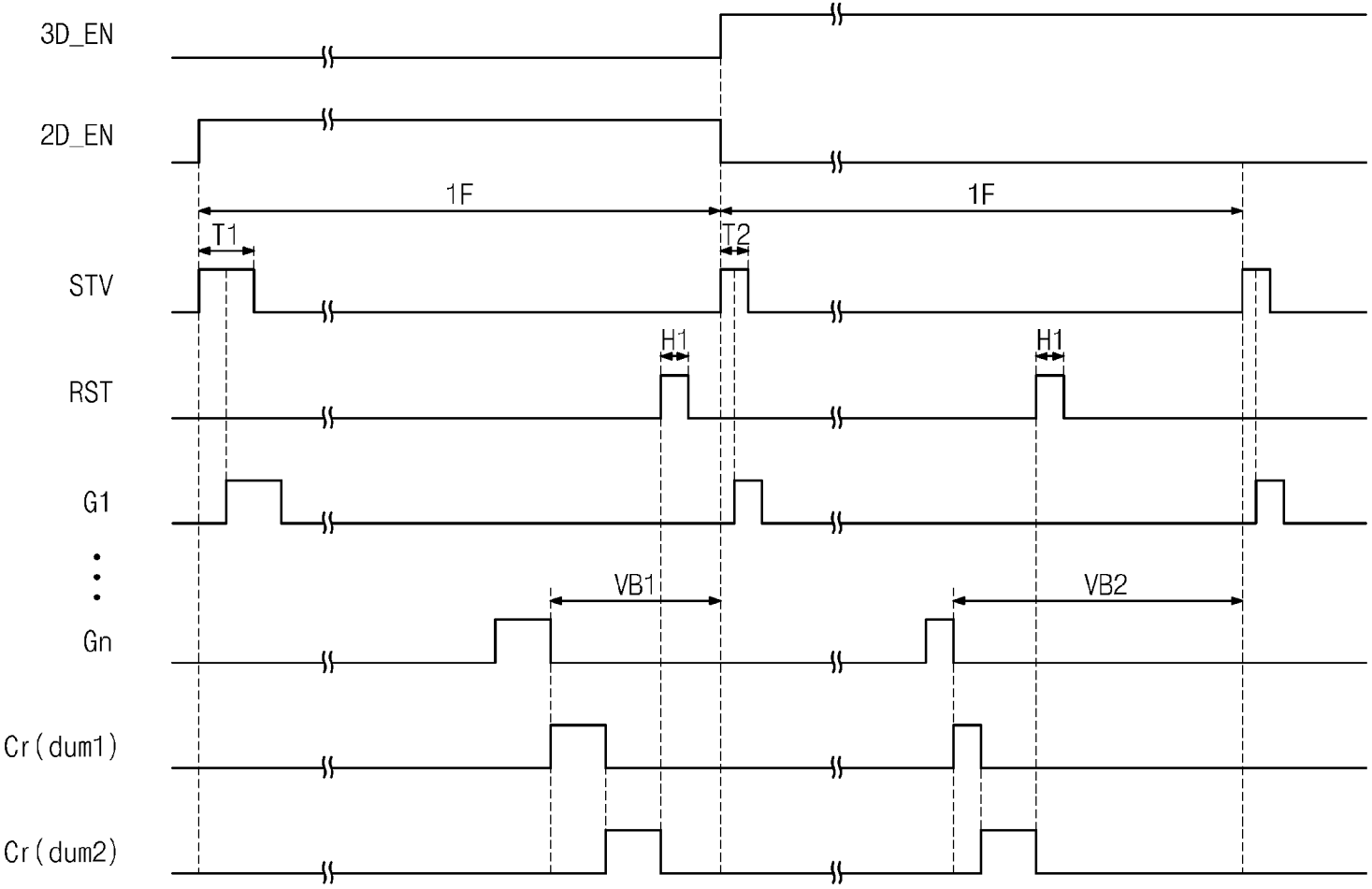
FIG. 6 is a signal timing diagram showing waveforms of a start signal, a reset signal, a gate signal, and first and second dummy carry signals of another alternative exemplary embodiment of the display apparatus.

FIG. 6 is a signal timing diagram showing waveforms of the start signal STV, the reset signal RST, the gate signals G1 to Gn, and the first and second dummy carry signals Cr(dum1) and Cr(dum2) of another alternative exemplary embodiment.

Referring to FIG. 6, in the case of the 2D mode, the reset signal RST is supplied to the second control terminal CT2 of the first dummy stage Dum1 and the first control terminal CT1 of the second dummy stage Dum2.

The reset signal RST includes the first high duration H1 within the first blank duration VB1. In an exemplary embodiment, the reset signal RST having a high level is applied to the second control terminal CT2 of the first dummy stage Dum1 and the first control terminal CT1 of the second dummy stage Dum2 during the first blank duration VB1.

When the reset signal RST is shifted to the high level, the second dummy stage Dum2 shifts the second dummy carry signal Cr(dum2) to the low level. When the reset signal RST is shifted to the high level, the first dummy stage Dum1 holds the first dummy carry signal Cr(dum1) at the low level.

Similarly to the 2D mode, in the case of the 3D mode, the reset signal RST is applied to the second control terminal CT2 of the first dummy stage Dum1 and the first control terminal CT1 of the second dummy stage Dum2.

The reset signal RST includes the first high duration H1 within the second blank duration VB2. The reset signal RST may be shifted to the high level after a predetermined clock elapses from the application of the last gate signal Gn.

When the reset signal RST is applied, the operations of the first and second dummy stages Dum1 and Dum2 are similar to the operations of the 2D mode.

The length of the first high duration H1 of the reset signal RST represents the same value in both the 2D and 3D modes. In an exemplary embodiment, the same reset signal RST is applied to the second control terminal CT2 of the first dummy stage Dum1 and the first control terminal CT1 of the second dummy stage Dum2 during the blank durations VB1 and VB2 regardless of the display modes.

In an exemplary embodiment, only the reset signal RST is applied to the first and second dummy stages Dum1 and Dum2, so that a signal applying scheme is substantially simplified as compared to the exemplary embodiments shown in FIGS. 4 and 5.

Figure 7:
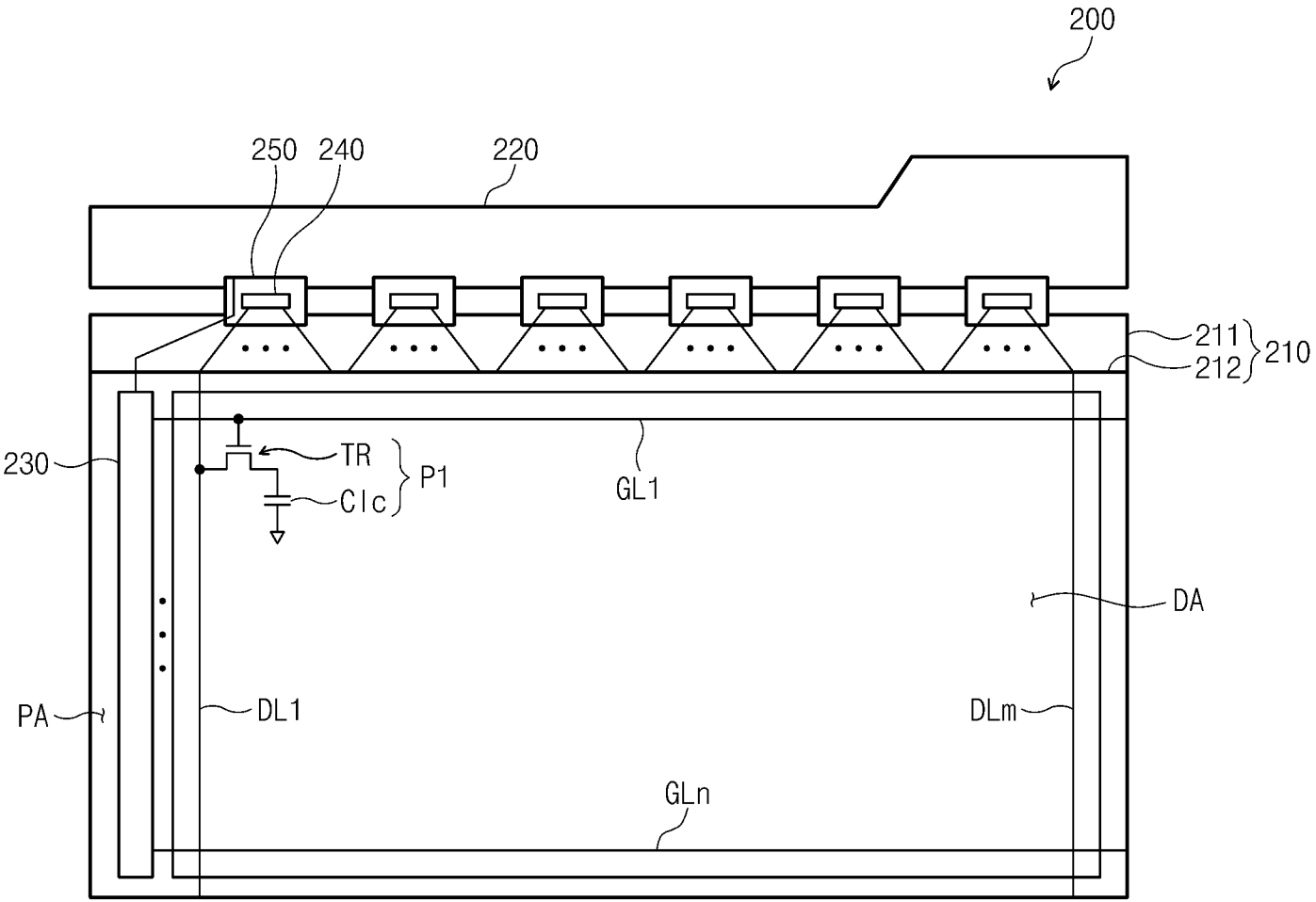
FIG. 7 is a top plan view showing an exemplary embodiment of a display apparatus according to the present invention.

FIG. 7 is a top plan view of an alternative exemplary embodiment of a display apparatus 200.

Referring to FIG. 7, an exemplary embodiment of the display apparatus 200 includes a display panel 210 that displays an image, a plurality of data driving chips 240 that outputs a data voltage to the display panel 210, and a gate driver 230 that outputs gate signals to the display panel 210.

The display panel 210 comprises a first substrate 210, a second substrate 220 disposed opposite to, e.g., facing, the first substrate 210, and a liquid crystal layer (not shown) interposed between the first and second substrates 210 and 220. The display panel 210 includes a display region DA to display an image and a peripheral region PA disposed adjacent to the display region DA.

The display region DA includes a plurality of gate lines GL1 to GLn and a plurality of data lines DL1 to DLm crossing the gate lines GL1 to GLn and insulated from the gate lines GL1 to GLn. The display region DA further includes a plurality of pixels P1, and each pixel P1 includes a thin film transistor TR and a liquid crystal capacitor Clc. In an exemplary embodiment, a gate electrode of the thin film transistor TR is electrically connected to a corresponding gate line, e.g., the first gate line GL1, a source electrode of the thin film transistor TR is electrically connected to a corresponding data line, e.g., the first data line DL1, and a drain electrode of the thin film transistor TR is electrically connected to a corresponding pixel electrode that may be a first electrode of the liquid crystal capacitor Clc.

The gate driver 230 is disposed in the peripheral region PA adjacent to one end of each of the gate lines GL1 to GLn. The gate driver 230 is electrically connected to the end of each of the gate lines GL1 to GLn and sequentially applies gate signals to the gate lines GL1 to GLn.

In an exemplary embodiment, the gate driver 230 is directly formed in the peripheral region PA of the first substrate 211 through a thin film process to form the pixels P1 on the first substrate 211. If the gate driver 230 is integrated in the first substrate 210 as described above, driving chips used to embed the gate driver 230 in the display apparatus 200 may be removed from the display apparatus 200, so that the productivity of the display apparatus 200 can be improved, and the whole size of the display apparatus 200 can be reduced.

A plurality of tape carrier packages ("TCP"s) 250 are disposed in the peripheral region PA adjacent to one end of each of the data lines DL1 to DLm. A plurality of data driving chips 240 is disposed on the TCPs 250. The data driving chips 240 are electrically connected to the one end of each of the data lines DL1 to DLm and output the data voltages to the data lines DL1 to DLm.

The display apparatus 200 further includes a printed circuit board 220 that controls the driving of the gate driver 230 and the data driving chips 240. The printed circuit board 220 outputs data control signals used to control the driving of the data driving chips 240 and image data, and outputs gate control signals used to control the driving of the gate driver 230. The data driving chips 240 receive the image data in synchronization with the data control signals, and convert the image data to the data voltages. In an exemplary embodiment, the gate driver 230 receives the gate control signal through the TCP 250, and sequentially outputs the gate signals in response to the gate control signals.

Accordingly, the display panel 210 charges the liquid crystal capacitor Clc with the data voltages in response to the gate signals, so that the transmittance of the liquid crystal layer may be adjusted, thereby displaying images.

While the present invention has been particularly shown and described with reference to the exemplary embodiments thereof, it will be understood by those of ordinary skill in the art that the present invention should not be limited to these exemplary embodiments but various changes and modifications may be made therein without departing from the spirit or scope of the present invention as hereinafter claimed.

What is claimed is:

1. A display apparatus comprising:

a display panel which displays an image in response to a plurality of gate signals and a plurality of data signals based on a display mode;

a data driver which provides the data signals to the display panel;

a gate driver which starts an operation thereof in response to a start signal, and comprises a plurality of stages and at least two dummy stages, wherein the plurality of stages sequentially provides the gate signals to the display panel, and the at least two dummy stages provide no gate signal to the display panel; and a timing controller which selects one of the start signal and a reset signal based on the display mode and outputs the selected one of the start signal and the reset signal to the at least two dummy stages, wherein each of the plurality of stages receives a clock signal, a previous carry signal from a previous stage thereof, a first subsequent carry signal from a first subsequent stage thereof and a second subsequent carry signal from a second subsequent stage thereof, and outputs a corresponding gate signal of the gate signals and a carry signal, and wherein each of the at least two dummy stages receives the selected one of the start signal and the reset signal as one of the first subsequent carry signal and the second subsequent carry signal.

2. The display apparatus of claim 1, wherein the timing controller outputs the reset signal having a phase different from a phase of the start signal to the dummy stages when the display mode is a three-dimensional image mode, and outputs the start signal to the dummy stages when the display mode is a two-dimensional image mode.

3. The display apparatus of claim 2, wherein the at least two dummy stages of the gate driver comprise:

a first dummy stage which outputs a first dummy carry signal; and a second dummy stage which outputs a second dummy carry signal, wherein the first dummy stage receives the clock signal, a carry signal of a last stage of the plurality of stages, the selected one of the start signal and the reset signal and the second dummy carry signal of the second dummy stage to output the first dummy carry signal, and wherein the second dummy stage receives the clock signal, the first dummy carry signal and the selected one of the start signal and the reset signal to output the second dummy carry signal.

4. The display apparatus of claim 2, wherein the reset signal comprises a first high duration in a blank duration, wherein the blank duration is defined as a time interval between a time point corresponding to a falling edge of a last gate signal of the gate signals and a time point corresponding to a rising edge of a subsequent high duration of the start signal.

5. The display apparatus of claim 4, wherein the reset signal further comprises a second high duration synchronized with a high duration of the start signal.

6. The display apparatus of claim 1, wherein each of the plurality of stages receives the previous carry signal from an adjacent previous stage thereof, and each of the plurality of stages receives the first subsequent carry signal and the second subsequent carry signal from two subsequent stages disposed sequentially adjacent thereto.

7. The display apparatus of claim 1, wherein the gate driver is directly formed on the display panel through a thin film process.

8. The display apparatus of claim 1, wherein each of the plurality of stages comprises:

a first output part which outputs a corresponding gate signal of the gate signals based on a potential of a first node;

a second output part which outputs the carry signal based on a potential of the first node;

a control part which increases the electrical potential of the first node in response to the previous carry signal, and decreases the corresponding gate signal to a first voltage in response to the first subsequent carry signal; and a holding part which receives the second subsequent carry signal, and supplies a second voltage lower than the first voltage to the first node.

9. The display apparatus of claim 8, wherein the controller comprises:

a buffer part which increases the electric potential of the first node in response to the previous carry signal;

a first pull down part which decreases the corresponding gate signal to the first voltage in response to the first subsequent carry signal;

a discharge part which decreases the electric potential of the first node to the second voltage in response to the first subsequent carry signal; and a second pull down part downing the carry signal to the second voltage in response to the first subsequent carry signal.

10. The display apparatus of claim 9, wherein each of the plurality of stages further comprises:

an inverter part which outputs the clock signal to a second node in response to the carry signal; and a second holding part which holds the gate signal and the carry signal with the first voltage according to potential of the second node.

11. The display apparatus of claim 10, wherein each of the plurality of stages further comprises:

a first stabilizing part which holds the potential of the first node with the second voltage according to the potential of the second node; and a second stabilizing part which holds the electric potential of the second node with the second voltage in response to the previous carry signal.

12. A display apparatus comprising:

a display panel which displays an image in response to gate signals and data signals;

a data driver which provides the data signals to the display panel;

a gate driver which starts an operation thereof in response to a start signal, and comprises a plurality of stages and at least two dummy stages, wherein the plurality of stages sequentially provides the gate signals to the display panel, and the at least two dummy stages provide no gate signal to the display panel; and a timing controller which outputs a reset signal to the at least two dummy stages, wherein a phase of the reset signal is different from a phase of the start signal, wherein each of the plurality of stages receives a clock signal, a previous carry signal from a previous stage, a first subsequent carry signal from a first subsequent stage and a second subsequent carry signal from a second subsequent stage, and outputs a corresponding gate signal and a carry signal, and wherein each of the at least two dummy stages receives the reset signal as one of the first subsequent carry signal and the second subsequent carry signal.

13. The display apparatus of claim 12, wherein the reset signal comprises a first high duration in a blank duration, wherein the black duration is defined as a time interval between a time point corresponding to a falling edge of a last gate signal of the gate signals and a time point corresponding to a rising edge of a subsequent high duration of the start signal.

14. The display apparatus of claim 12, wherein the at least two dummy stages of the gate driver comprise:

a first dummy stage which outputs a first dummy carry signal; and a second dummy stage which outputs a second dummy carry signal, wherein the first dummy stage receives the clock signal, a carry signal of a last stage of the plurality of stages, the reset signal and the second dummy carry signal of the second dummy stage to output the first dummy carry signal, and wherein the second dummy stage receives the clock signal, the first dummy carry signal, and the reset signal to output the second dummy carry signal.

15. A method of driving a display apparatus comprising a gate driver which comprises a plurality of stages and at least two dummy stages, the method comprising:

sequentially applying a plurality of gate signals to a display panel using a clock signal, a previous carry signal from a previous stage, a first carry signal from a first subsequent stage and a second carry signal from a second subsequent stage in response to a start signal;

displaying an image to the display panel in response to the gate signals and a plurality of data signals based on a display mode; and selecting one of the start signal and a reset signal based on the display mode, and applying the selected one of the start signal and the reset signal to each of the at least two dummy stages as the first carry signal and the second carry signal.

16. The method of claim 15, wherein the reset signal having a phase different from a phase of the start signal is applied to the at least two dummy stages when the display mode is a three-dimensional image mode, and the start signal is applied to the at least two dummy stages when the display mode is a two-dimensional image mode.

17. The method of claim 15, wherein the reset signal comprises a first high duration in a blank duration, wherein the blank duration is defined as a time interval between a time point corresponding to a falling edge of a last gate signal and a time point corresponding to a rising edge of a subsequent high duration of the start signal.

18. The method of claim 17, wherein the reset signal further comprises a second high duration synchronized with the start signal.

* * * * *